US005685401A

United States Patent [19]

Macgillivray et al.

[11] Patent Number: 5,685,401

[45] Date of Patent: Nov. 11, 1997

[54] LUGGAGE WITH PASSAGEWAY FOR RECEIVING A SUPPORTING HANDLE

[75] Inventors: Sally-Ann Macgillivray, Beeton; Marten Charles Mann, Stratford; Dianne Betty Mann, Stratford; Michael Gerard Culliton, Stratford, all of Canada

[73] Assignee: Samsonite Corporation, Denver, Colo.

[21] Appl. No.: 430,977

[22] Filed: Apr. 28, 1995

[51] Int. Cl.[6] ..... A45C 5/06; A45C 5/14; A45C 13/10; A45C 13/38

[52] U.S. Cl. ..... 190/108; 190/18 A; 190/102; 190/109; 190/112; 150/111

[58] Field of Search ..... 190/18 A, 102, 190/108, 109, 112, 110, 111, 115

[56] References Cited

U.S. PATENT DOCUMENTS

| | | | |
|---|---|---|---|
| 523,503 | 7/1894 | Alberschardt | 190/108 |
| 2,319,729 | 5/1943 | Ford . | |
| 2,372,845 | 4/1945 | Nelson | 190/108 |
| 2,574,786 | 11/1951 | Hiatt | 190/110 X |
| 2,813,602 | 4/1957 | MacArthur, Jr. | 190/110 X |
| 3,125,145 | 3/1964 | Williams | 383/7 |
| 3,696,850 | 10/1972 | Rosenblum | 190/108 |
| 3,729,038 | 4/1973 | Ekeson | 150/110 X |
| 3,837,447 | 9/1974 | Honan | 190/110 |
| 4,081,061 | 3/1978 | Tucker | 190/108 |
| 4,640,392 | 2/1987 | Decker, Jr. et al. | 190/102 X |
| 4,887,751 | 12/1989 | Lehman | 190/18 A |
| 4,995,436 | 2/1991 | Cantor | 190/108 X |
| 5,267,679 | 12/1993 | Kamaya et al. | 190/102 |
| 5,291,976 | 3/1994 | Ku | 190/18 A |
| 5,353,900 | 10/1994 | Stilley | 206/287.1 X |
| 5,354,131 | 10/1994 | Mogil . | |
| 5,402,869 | 4/1995 | Saltzhan et al. | 190/108 |
| 5,509,515 | 4/1996 | Guo | 190/108 X |

FOREIGN PATENT DOCUMENTS

| | | | |
|---|---|---|---|
| 2358124 | 2/1978 | France | 190/102 |
| 1458044 | 12/1976 | United Kingdom . | |
| 1456176 | 2/1978 | United Kingdom | 190/108 |
| 2257028 | 6/1993 | United Kingdom . | |

*Primary Examiner*—Sue A. Weaver
*Attorney, Agent, or Firm*—Gregory W. O'Connor; Rod D. Baker

[57] ABSTRACT

A piece of luggage has a first body portion joined to a second body portion along two spaced lines of stitching so as to form a passageway between the lines of stitching and between the facing sidewalls of the first and second body portions. This passageway has open ends such that the passageway may be registered with a handle of a wheeled suitcase and the piece of luggage slipped onto the handle in order to support the piece of luggage on the handle. The second body portion has a compartment and the piece of luggage may be oriented such that the compartment faces a user after the piece of luggage has been slipped onto a handle in order to provide a relatively secure and readily accessible pocket.

14 Claims, 9 Drawing Sheets

LUGGAGE WITH PASSAGEWAY FOR RECEIVING A SUPPORTING HANDLE

BACKGROUND OF THE INVENTION

1. Field of the Invention

This invention relates to a piece of luggage.

2. Description of the Related Art

Travellers often carry a number of pieces of luggage. Typically, at least one piece is bulky and at least one other piece is a relatively small tote. Many bulky pieces of luggage 10 have wheels and an extendible handle so that a user may wheel the bulky piece of luggage along by the handle after extending same.

It has been recognized that the handle bars of the extended handle could act as a support for a tote such that the tote could be transported on the wheeled luggage. Known totes adapted for this purpose either have complicated mechanisms for permitting the tote to be mounted on the handle bars or present catching hazards requiring closures to avoid such hazards.

The present invention seeks to overcome drawbacks of the known prior art.

SUMMARY OF THE INVENTION

According to the present invention, there is provided a piece of luggage comprising, a first body portion having at least one compartment; a second body port ion having a compartment; said second body portion joined to said first body portion so as to form a passageway (channel) between said first body portion and said second body portion, said passageway being open at two opposed ends end sized to permit a handle of a wheeled suitcase to pass therethrough.

DETAILED DESCRIPTION OF THE PREFERRED EMBODIMENTS

Figure 1:
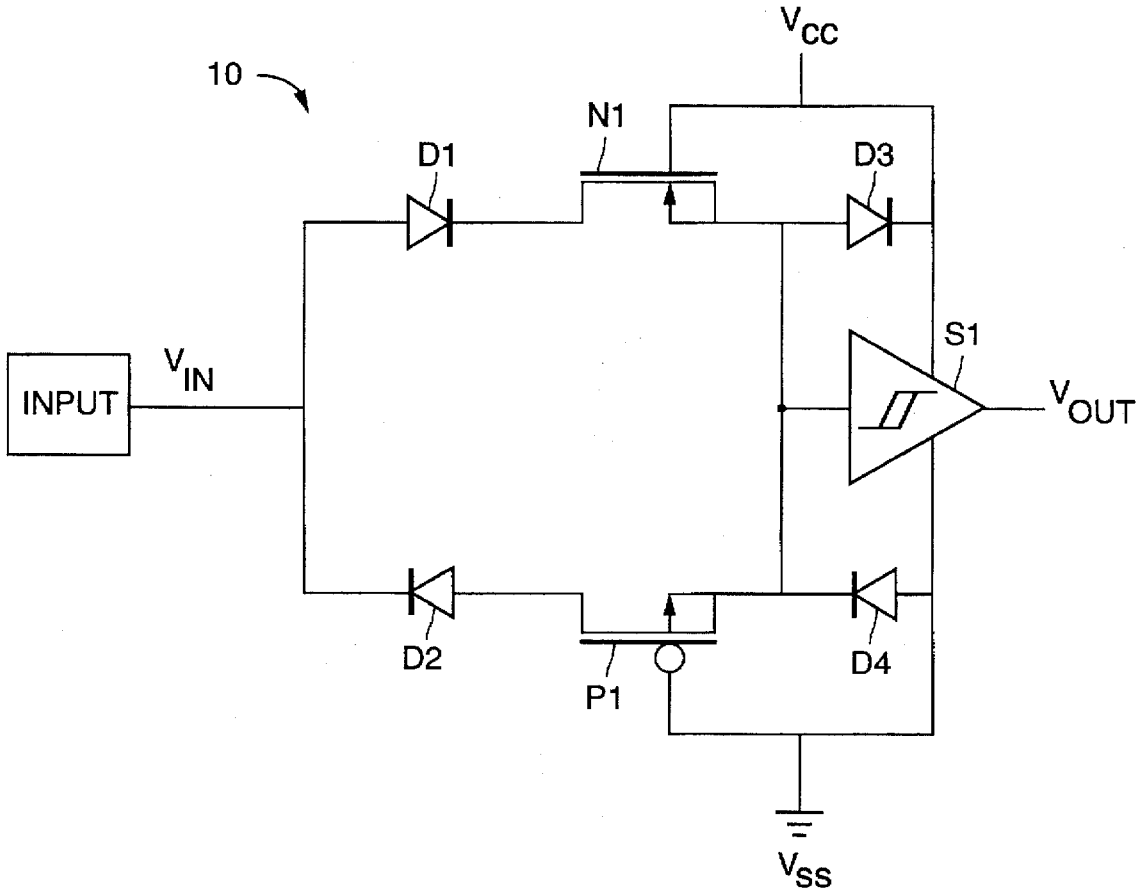
FIG. 1 is a perspective view of a piece of luggage made in accordance with this invention shown supported on a handle of a wheeled suitcase.

Turning to FIG. 1, a piece of luggage 10 made in accordance with this invention is shown in place on the handle bars 12 of an extensible handle 11 of a piece of wheeled luggage 14. Wheeled luggage 14 has wheels 16.

Figure 2:
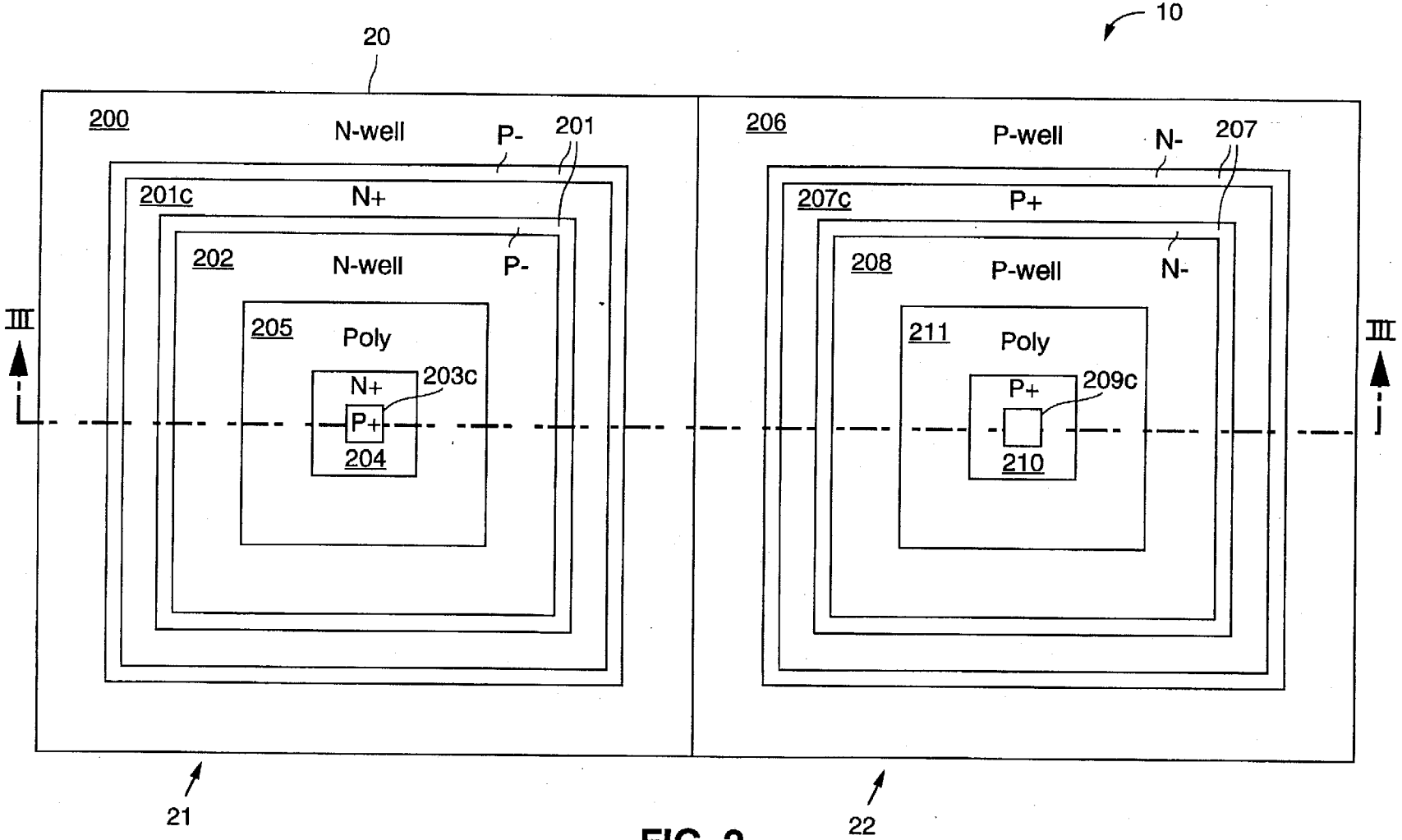
FIG. 2 is a perspective view looking in the direction of arrow 2 of FIG. 1.

Referencing FIG. 2, wheeled luggage 14 has a top 15 which interests a back 16 to define an upper back edge 17. FIG. 2 also shows that the piece of luggage 10 has a first body portion 20 with compartments 22 and 24. The piece of luggage also has a second body portion 30 with compartment 32. The second body portion 30 is joined to the first body portion 20 so as to form a passageway, or channel, 40 between the first and second body portions. This passageway is sized for receiving handle 11 of the wheeled suitcase 14. Compartment 32 of the second body portion 30 has a zipper fastener 34 which extends along a top wall 36 of the second body portion 30.

Figure 3:
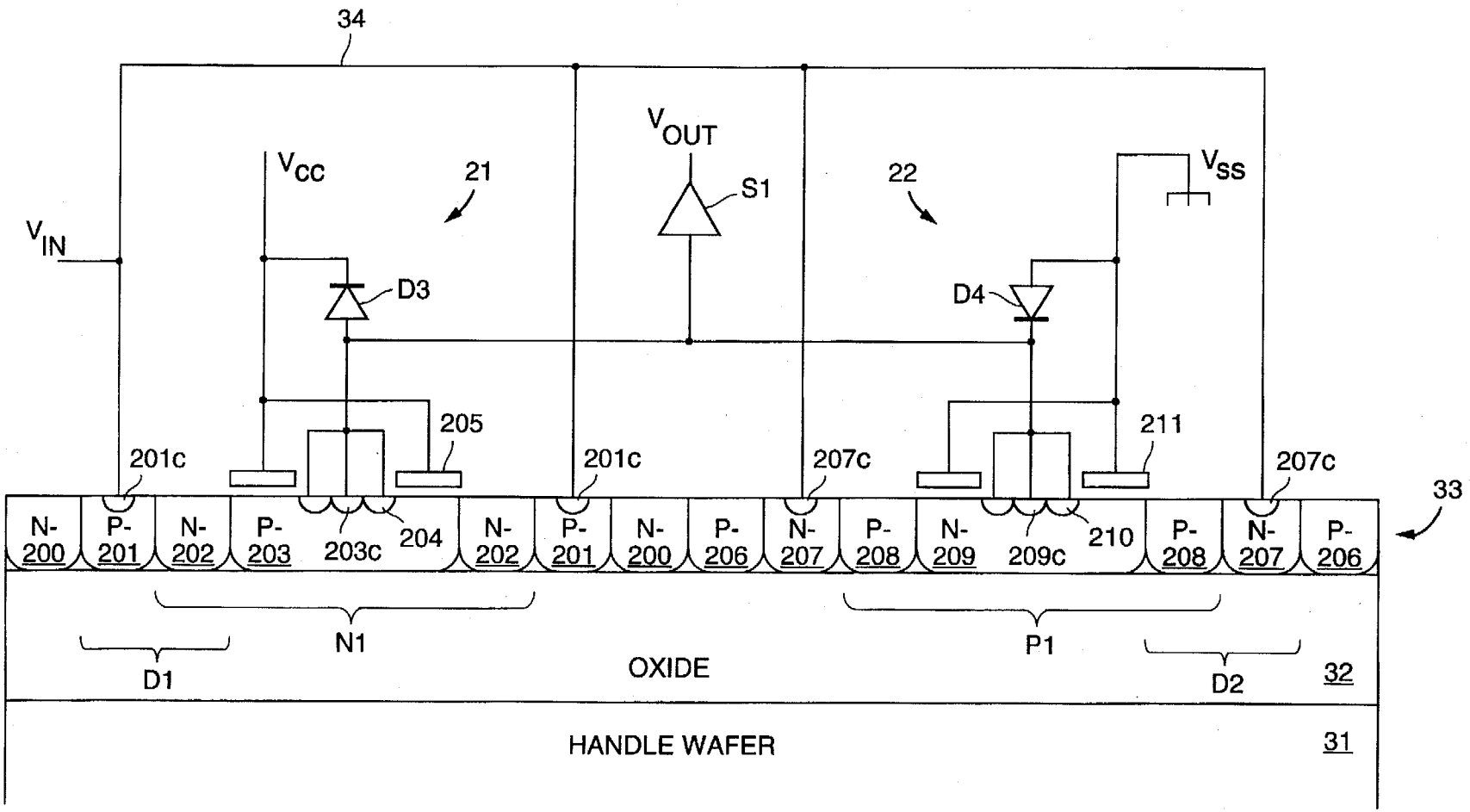
FIG. 3 is a partially cross-sectional view along the lines 3—3 of FIG. 2.
Figure 4A:
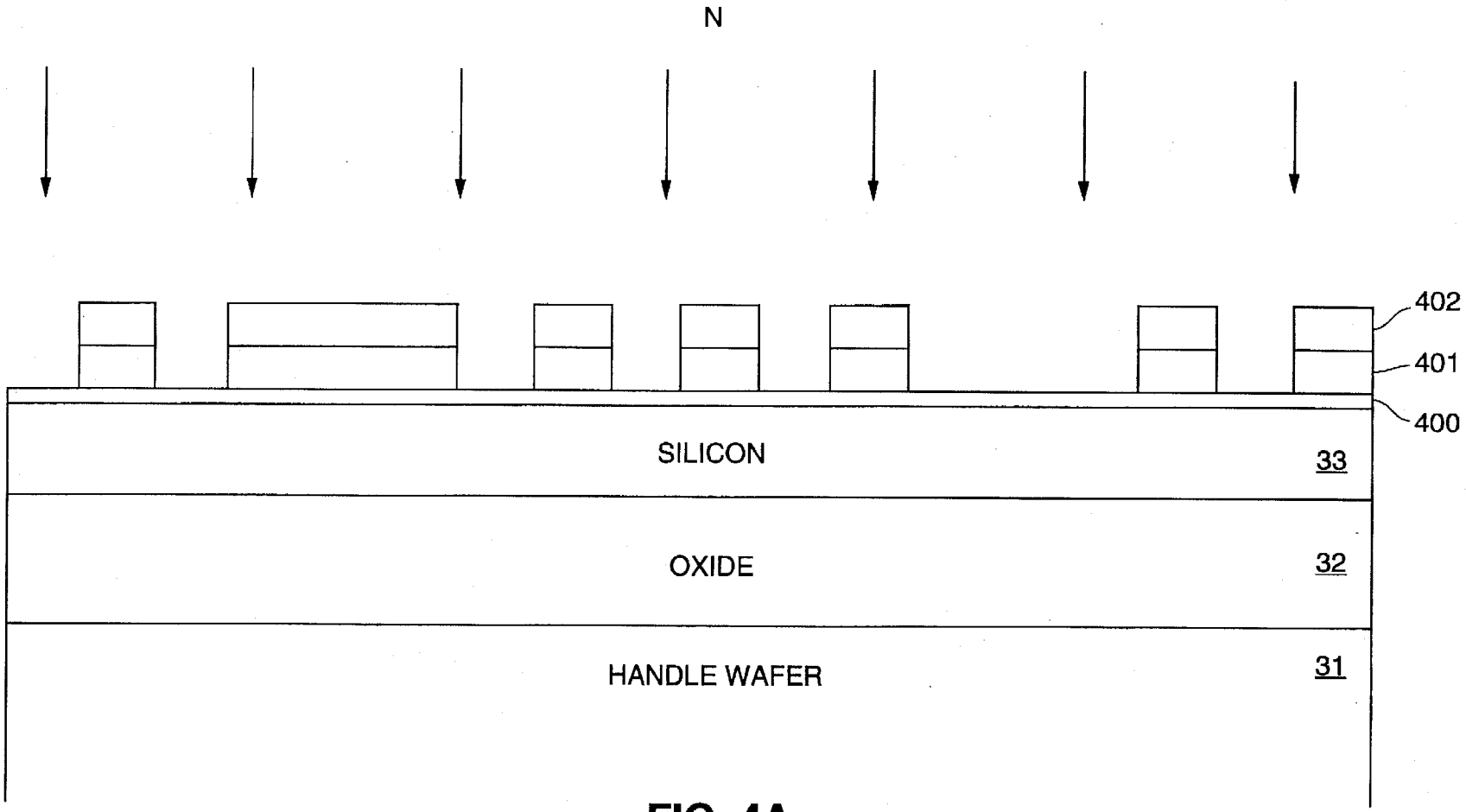
FIG. 4 is a cross-sectional view along the lines 4—4 of FIG. 2.
Figure 4B:
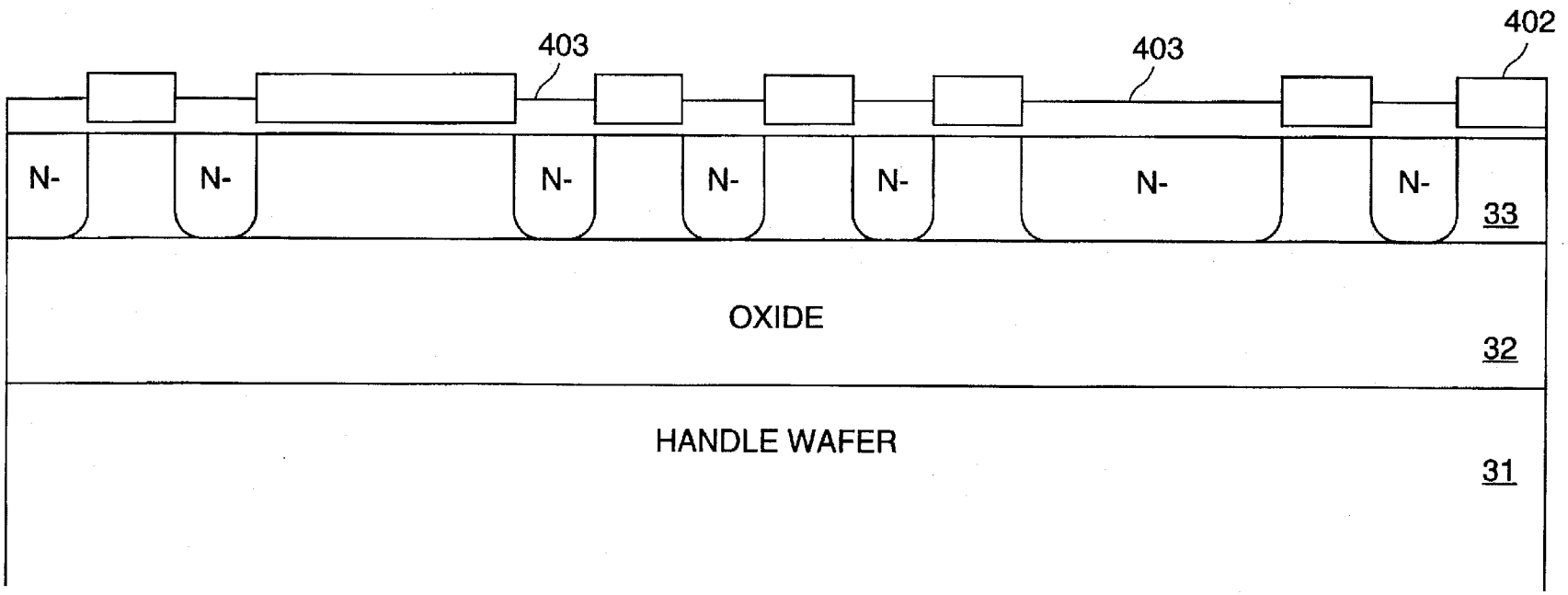
Figure 4C:
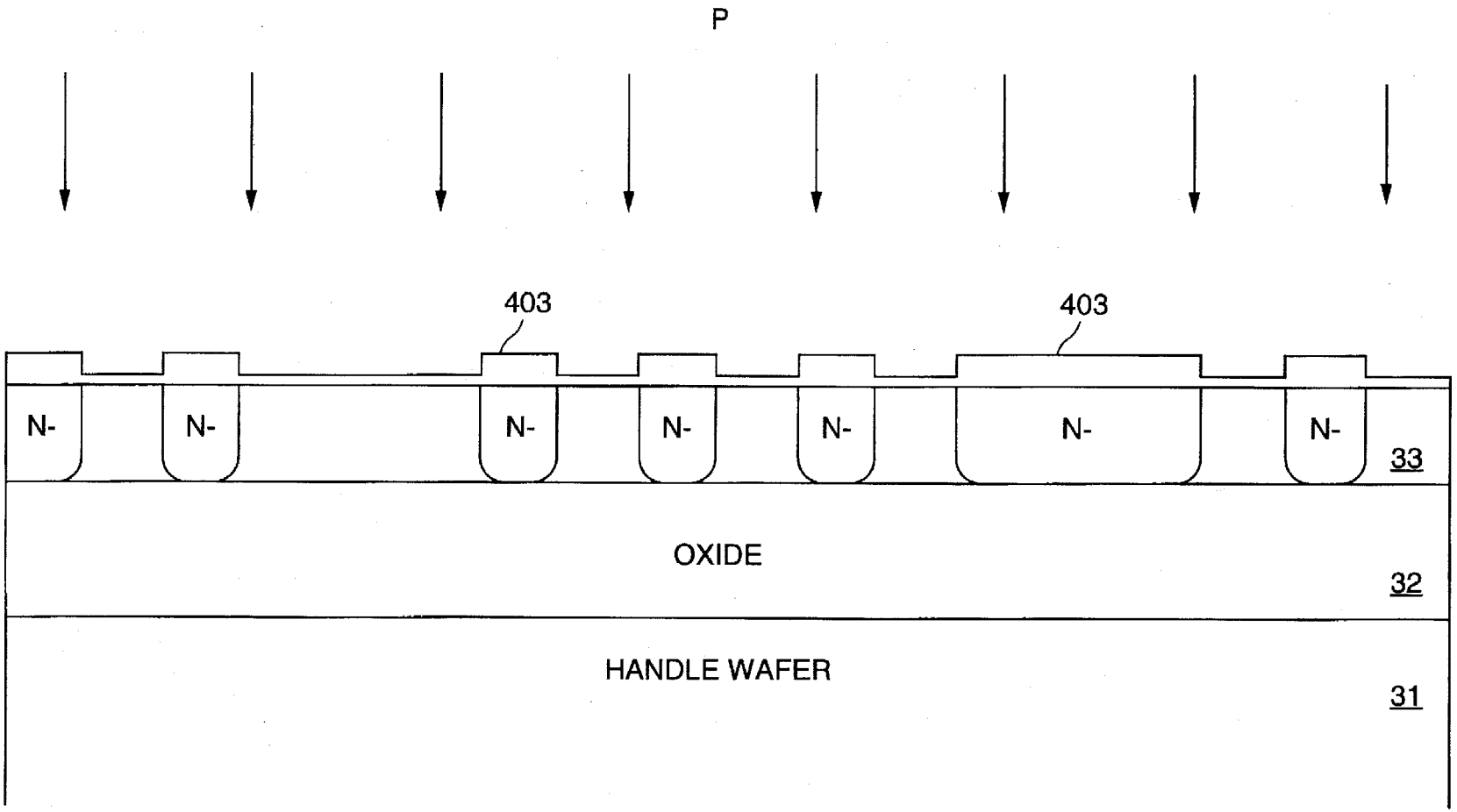
Figure 4D:
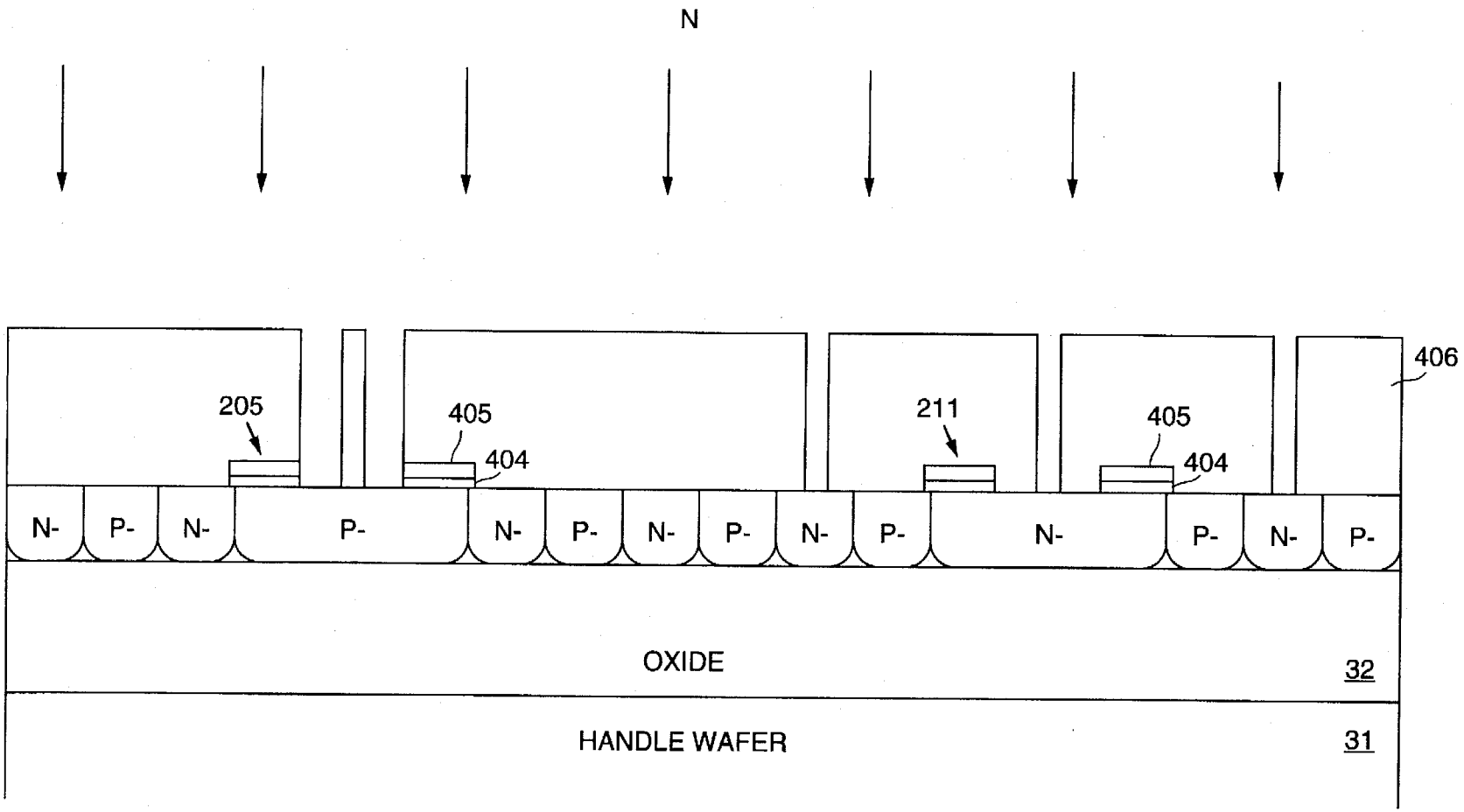
Figure 4E:
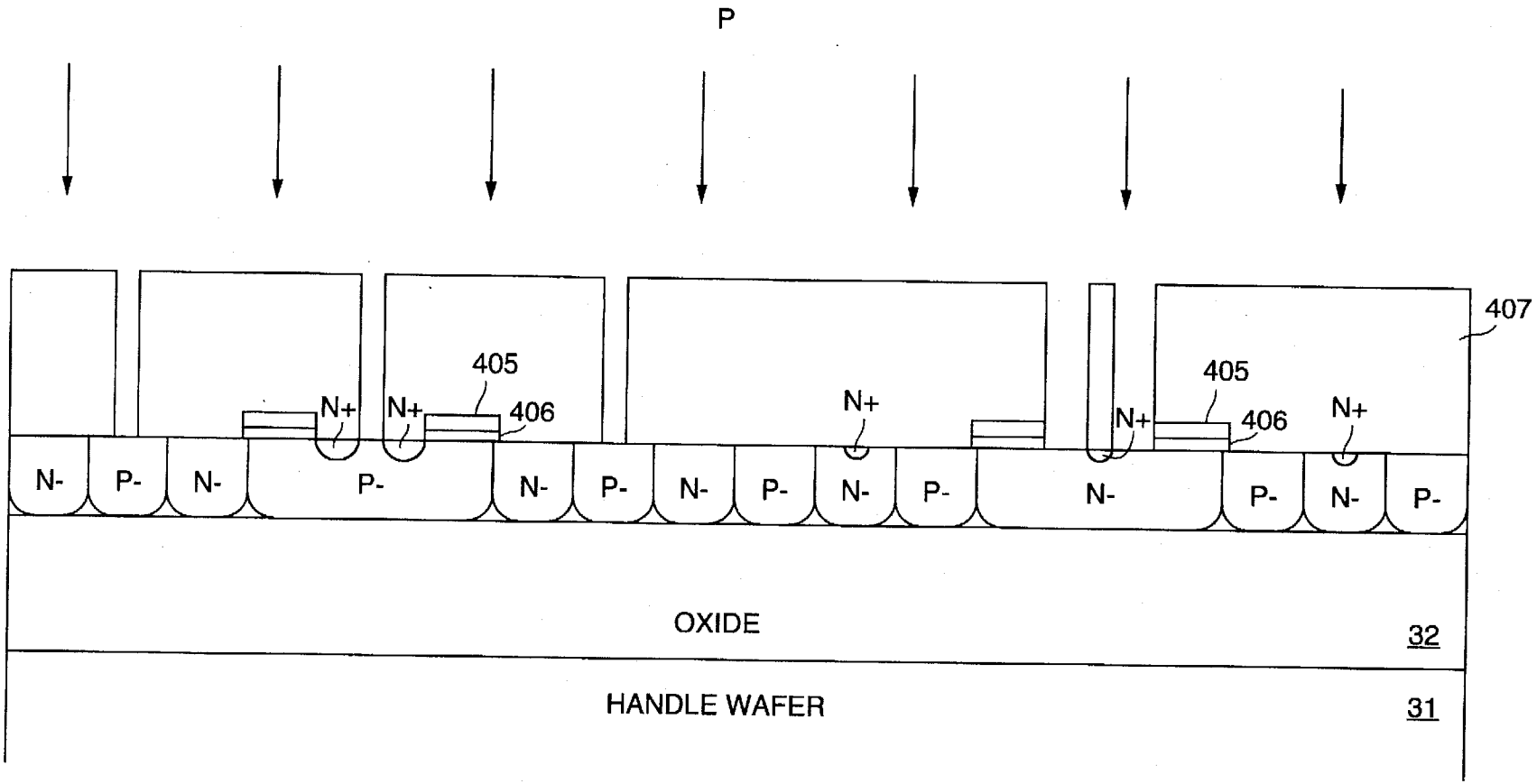
Figure 4F:
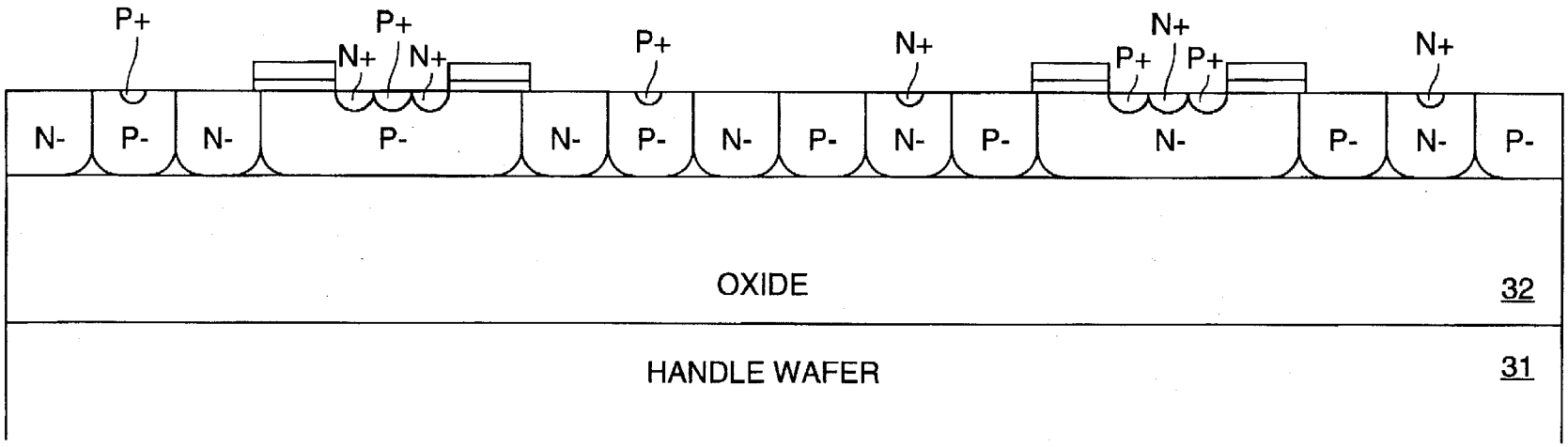
Figure 1:
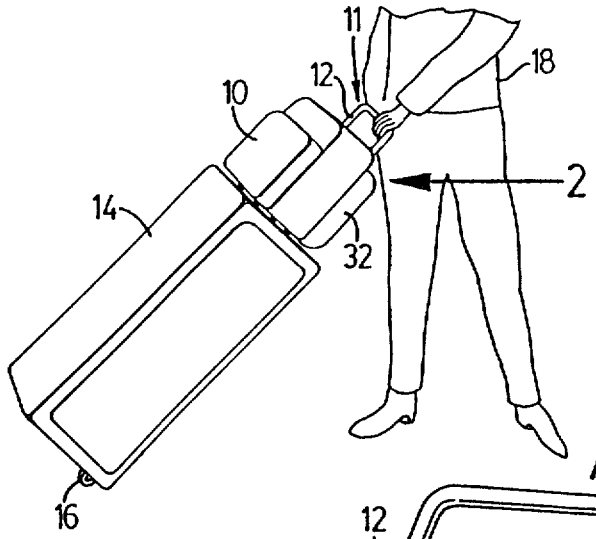
Figure 2:
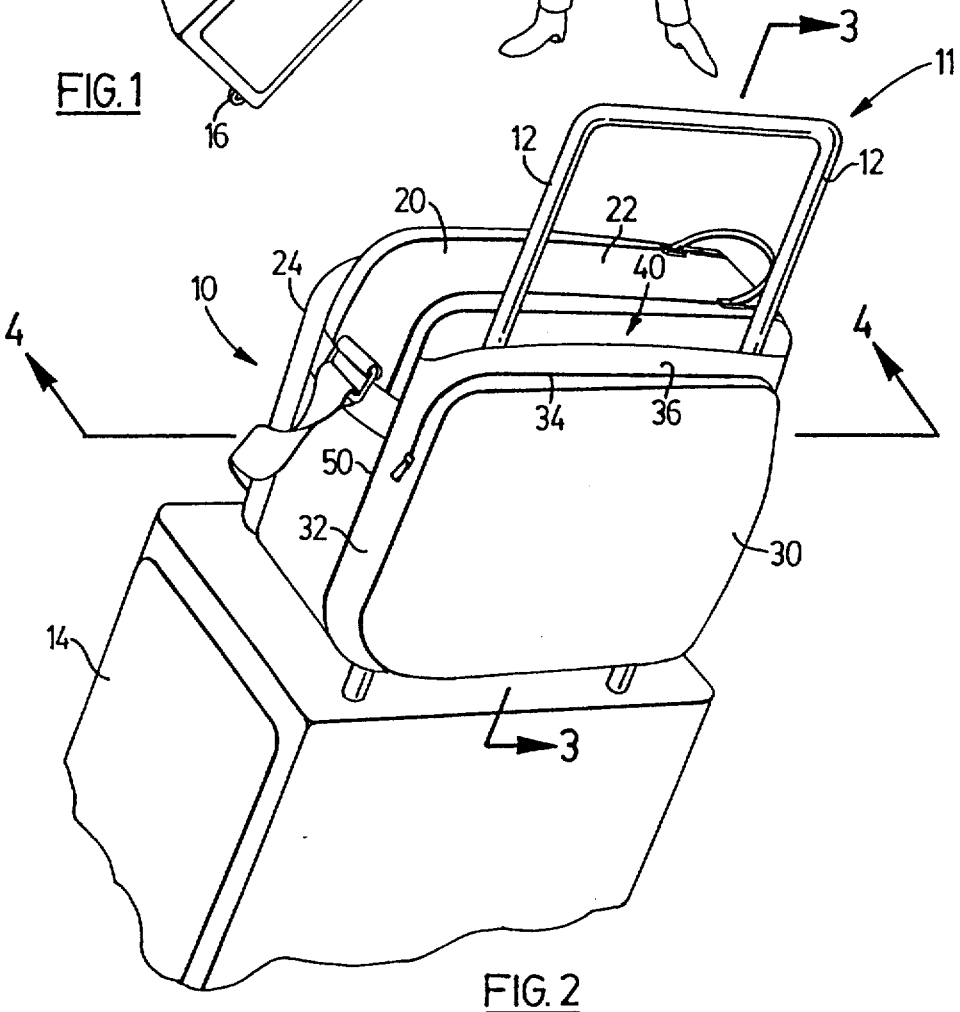
Figure 3:
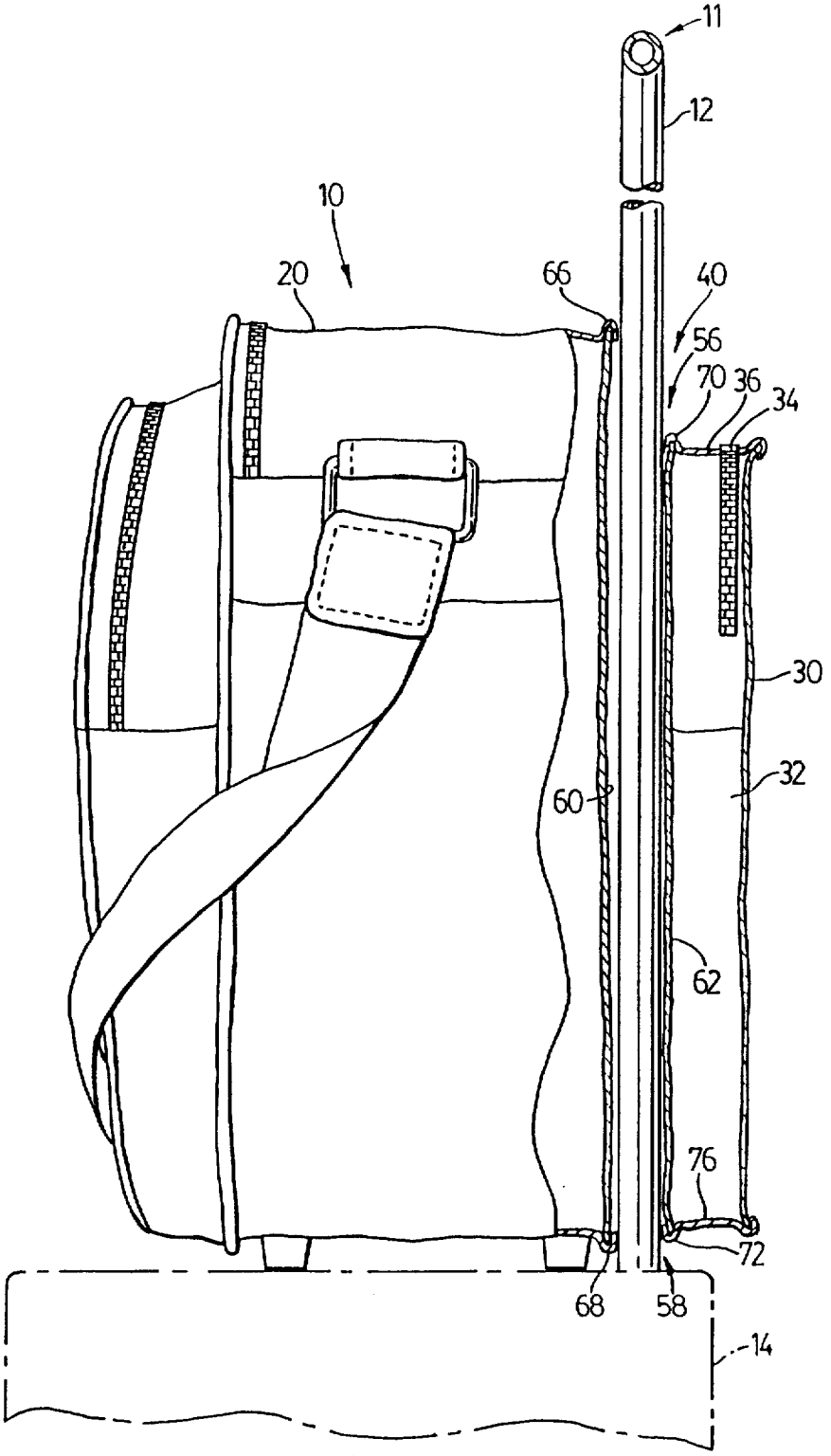
Figure 4:
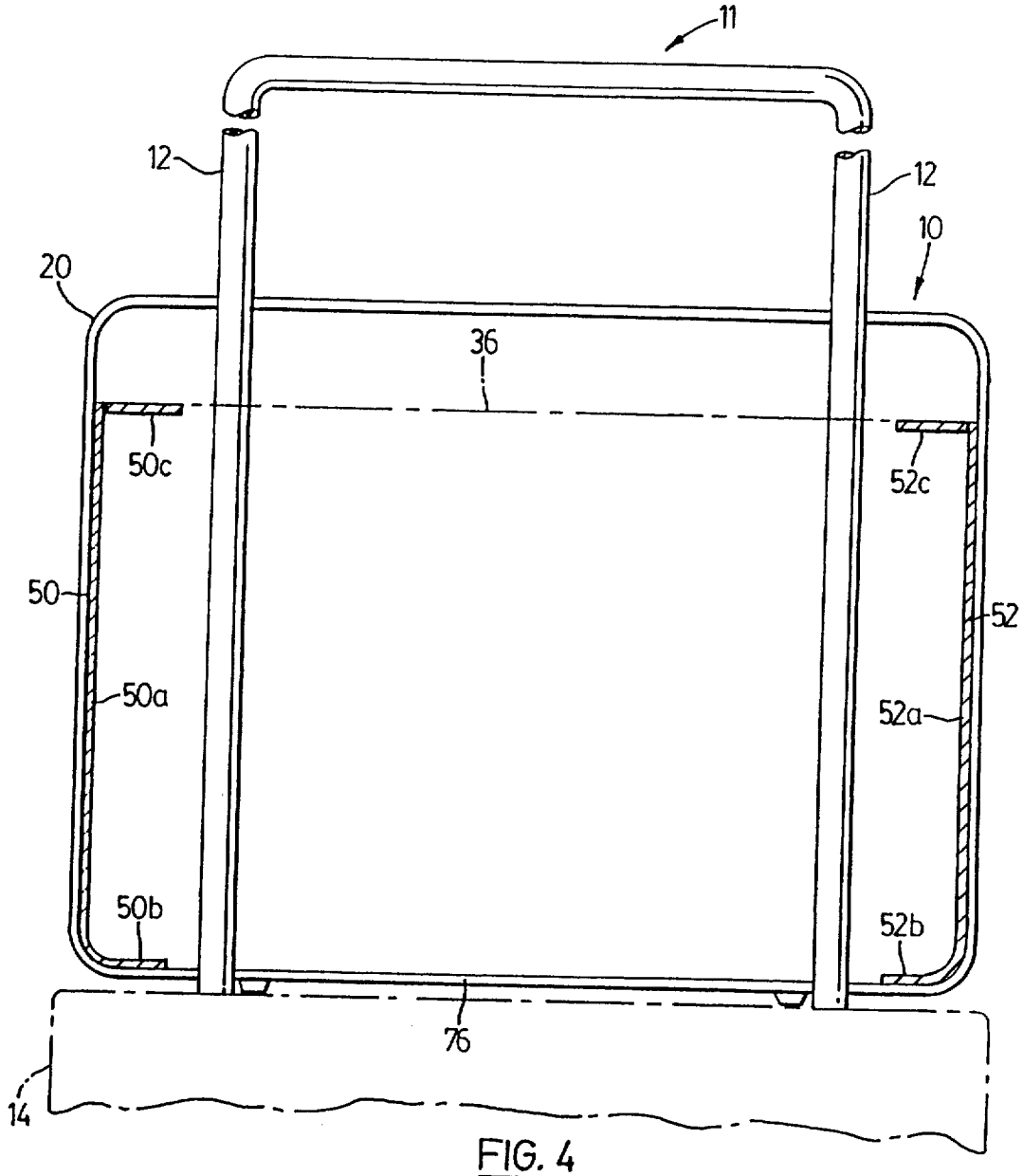

From FIG. 3 and FIG. 4, it will be apparent that the join between the body portions 20, 30 results from join lines 50 and 52 between sidewall 62 of the second body portion 30 and sidewall 60 of the first body portion 20. These join lines are lines of stitching comprising a main section 50*a*, 52*a* extending along opposed edges of the second body portion between a short extension 50*b*, 52*b* along the bottom 76 of the second body portion 30 and a short extension 50*c*, 52*c* along the top 36 of the second body portion such that the resulting passageway 40 is open at both of its ends 56 and 58. As will be apparent from FIG. 4, the main sections 50*a*, 52*a* of the two join lines 50, 52 are parallel to each other and the join lines 50, 52 are spaced to permit the handle 11 of the wheeled suitcase to pass through the passageway.

From FIG. 3, it will be noted that sidewall 60 of the first body portion 20 has wear resistant protuberances in the nature of beads or protective cloth welts 66 and 68 directed toward sidewall 62 of the second body portion 30. Similarly, the second body port ion 30 has wear resistant beads or protective cloth welts 70 and 72 directed toward the sidewall 60 of the first body portion.

As will be apparent from the figures, the piece of luggage 10 is soft-sided.

In use, the passageway 40 of the piece of luggage 10 may be registered with extended handle 11 of a wheeled suitcase 14 and the piece of luggage moved toward the handle such that the passageway receives the handle. Once the piece of luggage is slipped onto the handlebars 12, it will be supported by the handle. The top 50*c*, 52*c* and bottom 50*b*, 52*b* extensions of the join lines act to centre the handle bars 12 in the passageway 40 thereby improving the stability of the piece of luggage 10 on the piece of luggage 14. If the piece of luggage 10 is oriented as shown in the figures, compartment 32 extends beyond the back edge 17 toward a user 18 (FIGS. 1 and 3) when the piece of luggage 14 is being wheeled along. This provides a relatively secure compartment on the piece of luggage 10 which is still readily accessible by a user. It will also be apparent from the figures that whether or not the piece of luggage 10 is supported on handle 11 of a piece of wheeled luggage 14, the provision of passageway 40 through the luggage 10 creates a minimal catching hazard. This is in part due to the extensions 50*b*, 52*b*, 50*c*, 52*c* of the join lines 50, 52 which aid in maintaining the passageway 40 in a substantially closed condition, when the piece of luggage 10 is not supported on handle bars 12, and opened only so far as required to accommodate handle bars 12, when the piece is in place on the handle bars.

The beads or welts 66, 68, 70 and 72 (FIG. 3) extend toward handle 11 so as to reduce the wear on sidewalls 60 and 62 resulting from the movement of luggage 10 on handle bars 12.

Modifications to the invention will be apparent to those skilled in the art and, therefore, the invention is defined in the claims.

What is claimed is:

1. A piece of luggage comprising:

a first body portion having at least one compartment and two opposed edges;

a second body portion having a compartment;

said second body portion permanently joined to said first body portion along two lines of stitching, whereby said opposed edges of said second body portion are stitched directly to said first body portion so as to form a passageway between said lines of stitching and defined by said first body portion and said second body portion, said passageway being open at two opposed ends and sized to permit a handle of a wheeled suitcase to pass therethrough.

2. The piece of luggage of claim 1 wherein at least one of said first body portion sidewall and said second body portion sidewall has a wear resistant protuberance directed toward the other of said first body portion sidewall and said second body portion sidewall.

3. The piece of luggage of claim 2 wherein said second body portion has a closure for closing said second body portion compartment.

4. The piece of luggage of claim 3 wherein said first body portion and said second body portion are soft-sided.

5. A piece of luggage comprising:

a first body portion having at least one compartment; and a second body portion having a compartment;

said second body portion permanently joined to said first body portion along two opposed edges of said second body portion so as to form a passageway between said first body portion and said second body portion, said passageway being open at two opposed ends and sized to permit a handle of a wheeled suitcase to pass therethrough; and wherein said two opposed edges are side edges of said second body portion and wherein said second body portion is also joined to said first body portion along portions of a top edge of said second body portion extending from each of said two opposed side edges and wherein said second body portion is also joined to said first body portion along portions of a bottom edge of said second body portion extending from each of said two opposed side edges.

6. A piece of luggage, disposable around the handle of a wheeled suitcase, comprising:

a first body portion having at least one compartment therein;

a second body portion having a compartment therein;

a sidewall of said second body portion being joined to a sidewall of said first body portion along a first join line and along a second join line;

said second join line being spaced from said first join line so as to define a channel which extends between said first join line and said second join line and between said sidewall of said first body portion and said sidewall of said second body portion, said channel sized to permit the handle of a wheeled suitcase to pass therethrough; and wherein at least one of said join lines comprises a permanent connection between said first body portion and said second body portion, and wherein at least one of said sidewalls is substantially parallel to and in contact with the handle when the piece of luggage is disposed around the handle.

7. The piece of luggage of claim 6 wherein said first join line and said second join line are formed by lines of stitching.

8. The piece of luggage of claim 6 wherein at least one of said first body portion sidewall and said second body portion sidewall has at least one wear resistant protuberance directed toward the other of said first body portion sidewall end said second body portion sidewall.

9. The piece of luggage of claim 6 wherein said first join line and said second join line extend along said sidewall of said second body portion from a bottom of said second body portion to a top of said second body portion.

10. The piece of luggage of claim 9 wherein each of said first join line and said second join line have a main section extending along a side edge of said second body portion, a top extension extending from said main section along a portion of a top edge of said second body portion, and a bottom extension extending from said main section along a portion of a bottom edge of said second body portion.

11. The piece of luggage of claim 10 wherein said second body portion has a closure for closing said compartment, said closure extending along a top wall of said second body portion.

12. The piece of luggage of claim 11 wherein said first body portion sidewall and said second body portion sidewall are flexible.

13. A luggage system comprising a piece of luggage removably connectible to a larger suitcase, the larger suitcase having wheels and an extended wheel handle which a user may grip to wheel the larger suitcase across a supporting surface, characterized in that:

the piece of luggage comprises:

a first body portion having at least one compartment therein;

a second body portion having a compartment therein;

a sidewall of said first body portion;

a sidewall of said second body portion substantially parallel to said sidewall of said first body portion and permanently joined to said sidewall of said first body portion along a first join line and along a second join line, said first join line and said second join line being in substantially parallel spaced-apart relation; and an elongated channel between said first join line and said second join line and defined by said sidewall of said first body portion and said sidewall of said second body portion; and wherein said channel is sized to permit the wheel handle to pass therethrough, and wherein the extended wheel handle is received through said channel, in substantial contact with at least one of said sidewalls, thereby removably connecting said piece of luggage to said larger suitcase.

14. The luggage system of claim 13, wherein the second body portion has a depth dimension perpendicular to said sidewall of said second body portion, and wherein the larger suitcase comprises:

a back, said back in facing relation to the user when the user grips the wheel handle;

a top intersecting the back, the intersection defining a back edge; and the extended wheel handle extends from said top at a location spaced from said back edge a distance less than said depth dimension of said second body portion;

said first body portion rests upon said top when the extended wheel handle is received through said channel; and said second body portion extends beyond said back edge and toward the user when the extended wheel handle is received through said channel.

* * * * *

UNITED STATES PATENT AND TRADEMARK OFFICE

CERTIFICATE OF CORRECTION

PATENT NO. : 5,685,401
DATED : Nov. 11, 1997
INVENTOR(S) : Macgillivray et al.

It is certified that error appears in the above-identified patent and that said Letters Patent is hereby corrected as shown below:

The title page should be deleted to appear as per attached title page.

Please delete drawing sheets 1- 9 and substitute drawing sheets 1- 3 as per attached.

Signed and Sealed this

Twelfth Day of January, 1999

*Attest:*

*Attesting Officer*

*Acting Commissioner of Patents and Trademarks*

US005685401A

United States Patent [19]

Macgillivray et al.

[11] Patent Number: 5,685,401

[45] Date of Patent: Nov. 11, 1997

[54] LUGGAGE WITH PASSAGEWAY FOR RECEIVING A SUPPORTING HANDLE

[75] Inventors: Sally-Ann Macgillivray, Beeton; Marten Charles Mann, Stratford; Dianne Betty Mann, Stratford; Michael Gerard Culliton, Stratford, all of Canada

[73] Assignee: Samsonite Corporation, Denver, Colo.

[21] Appl. No.: 430,977

[22] Filed: Apr. 28, 1995

[51] Int. Cl.[6] ..... A45C 5/06; A45C 5/14; A45C 13/10; A45C 13/38

[52] U.S. Cl. ..... 190/108; 190/18 A; 190/102; 190/109; 190/112; 150/111

[58] Field of Search ..... 190/18 A, 102, 190/108, 109, 112, 110, 111, 115

[56] References Cited

U.S. PATENT DOCUMENTS

| | | | |
|---|---|---|---|
| 523,503 | 7/1894 | Alberschardt | 190/108 |
| 2,319,729 | 5/1943 | Ford . | |
| 2,372,845 | 4/1945 | Nelson | 190/108 |
| 2,574,786 | 11/1951 | Hiatt | 190/110 X |
| 2,813,602 | 4/1957 | MacArthur, Jr. | 190/110 X |
| 3,125,145 | 3/1964 | Williams | 383/7 |
| 3,696,850 | 10/1972 | Rosenblum | 190/108 |
| 3,729,038 | 4/1973 | Ekeson | 150/110 X |
| 3,837,447 | 9/1974 | Honan | 190/110 |
| 4,081,061 | 3/1978 | Tucker | 190/108 |
| 4,640,392 | 2/1987 | Decker, Jr. et al. | 190/102 X |
| 4,887,751 | 12/1989 | Lehman | 190/18 A |
| 4,995,436 | 2/1991 | Cantor | 190/108 X |
| 5,267,679 | 12/1993 | Kamaya et al. | 190/102 |
| 5,291,976 | 3/1994 | Ku | 190/18 A |
| 5,353,900 | 10/1994 | Stilley | 206/287.1 X |
| 5,354,131 | 10/1994 | Mogil . | |
| 5,402,869 | 4/1995 | Saltzhan et al. | 190/108 |
| 5,509,515 | 4/1996 | Guo | 190/108 X |

FOREIGN PATENT DOCUMENTS

| | | | |
|---|---|---|---|
| 2358124 | 2/1978 | France | 190/102 |
| 1458044 | 12/1976 | United Kingdom . | |
| 1456176 | 2/1978 | United Kingdom | 190/108 |
| 2257028 | 6/1993 | United Kingdom . | |

*Primary Examiner*—Sue A. Weaver
*Attorney, Agent, or Firm*—Gregory W. O'Connor; Rod D. Baker

[57] ABSTRACT

A piece of luggage has a first body portion joined to a second body portion along two spaced lines of stitching so as to form a passageway between the lines of stitching and between the facing sidewalls of the first and second body portions. This passageway has open ends such that the passageway may be registered with a handle of a wheeled suitcase and the piece of luggage slipped onto the handle in order to support the piece of luggage on the handle. The second body portion has a compartment and the piece of luggage may be oriented such that the compartment faces a user after the piece of luggage has been slipped onto a handle in order to provide a relatively secure and readily accessible pocket.

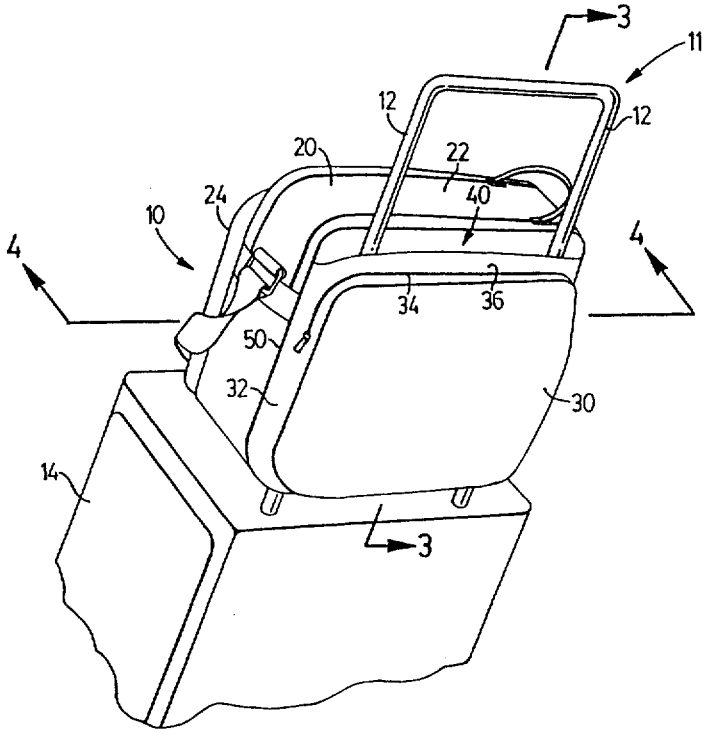

14 Claims, 3 Drawing Sheets